United States Patent [19]

Janecke

[11] Patent Number: 4,889,161

[45] Date of Patent: Dec. 26, 1989

[54] COMPENSATED INDIVIDUAL SEGMENT FLOW REGULATOR

[75] Inventor: James P. Janecke, Waukesha, Wis.

[73] Assignee: Applied Power Inc., Milwaukee, Wis.

[21] Appl. No.: 240,481

[22] Filed: Sep. 6, 1988

Related U.S. Application Data

[63] Continuation of Ser. No. 103,610, Oct. 2, 1987, abandoned.

[51] Int. Cl.[4] ..... F15B 13/04

[52] U.S. Cl. ..... 137/596; 91/446

[58] Field of Search ..... 91/446; 137/596, 596.13

[56] References Cited

U.S. PATENT DOCUMENTS

| | | | |
|---|---|---|---|
| 3,534,774 | 10/1970 | Tennis | 137/596 |
| 3,688,600 | 8/1987 | Kreth et al. | 137/596.13 X |
| 3,722,543 | 3/1973 | Tennis | 137/596.13 X |
| 3,934,742 | 1/1976 | Tennis | 137/596 X |
| 4,253,482 | 3/1981 | Stephens | 137/596.13 X |
| 4,352,375 | 10/1982 | Williams . | |
| 4,361,169 | 11/1982 | Williams . | |
| 4,519,419 | 5/1985 | Petro . | |
| 4,574,839 | 3/1986 | Yeh et al. . | |
| 4,693,272 | 9/1987 | Wilke | 137/596 |

*Primary Examiner*—Gerald A. Michalsky

*Attorney, Agent, or Firm*—Quarles & Brady

[57] ABSTRACT

An individual segment flow regulator is shown having a two landed spool and two landed bore, all with the same nominal diameter, a plug, a spring and a sensing passage from the main spool of the valve. Supply oil entering between the two lands of the bore is separated from a sensing pressure by one spool land which is slidable within the bore. The other spool land meters the supply fluid. The metering land of the regulator spool opens away from the valve bore land to allow supply fluid through and can shut off the supply. A spring chamber above the spool senses the load pressure which opens the metering spool, thereby increasing the flow and therefore the pressure drop across the main spool area opening. Feedback pressure developed at the bottom of the metering land of the spool is used to close down the regulator spool as the flow, and therefore the pressure drop, across the main spool increases beyond the pre-load force of the bias spring. The feedback land at the bottom of the spool is also the metering land that controls supply pressure to the regulated pressure.

23 Claims, 2 Drawing Sheets

COMPENSATED INDIVIDUAL SEGMENT FLOW REGULATOR

This is a continuation of co-pending application Ser. No. 07/103,610 filed on Oct. 2, 1987, now abandoned.

BACKGROUND OF THE INVENTION

1. Field of the Invention

The present invention relates generally to the art of hydraulic valves used to regulate fluid flow. More specifically, the present invention relates to a valve which controls the flow across the spool opening of a proportional, directional valve as load or system pressures fluctuate.

2. Description of Related Area of Art

Other valves and devices used to control the flow of a fluid have been developed in the past. U.S. Pat. No. 4,361,169 issued to Williams on Nov. 30, 1982 shows a multiple section control valve bank.

Metering and logic elements comprise a control valve section which is connected to a signal chamber designed to change the flow of fluid through the inlet of the valve depending the signals generated from the metering and logic elements. Williams employes a spool and a bore requiring a number of lands and U-shaped passages to generate the proper signals and control characteristics.

U.S. Pat. No. 4,352,375 issued to Williams on Oct. 5, 1982 also discloses a control valve bank. As with the earlier Williams patent, a number of lands are employed along with an intricate heart-shaped flow passage to control fluid flow around a dual supply passage.

U.S. Pat. No. 4,519,419 issued to Petro on May 28, 1985 discloses a hydraulic valve which utilizes a hollow piston having several separate lands with different diameters and various seal diameters.

Finally, U.S. Pat. No. 4,574,839 issued on Mar. 11, 1986 to Yeh, et al discloses a pressure compensated directional control valve. The valve allows the flow rate to a given hydraulic load to be constant regardless of the load imposed and uses a piston mounted within a sleeve valve insert and a number of springs, wherein the piston moves to create a variable orifice to control the hydraulic fluid flow to the load. An adjustable sleeve works in connection with a hollow piston to provide for proper operation of the valve.

OBJECTS AND SUMMARY OF THE INVENTION

It is an object of the present invention to provide an improved individual segment flow regulator, the operation of which is simpler and less expensive than devices utilized in the past.

It is another object of the present invention to provide a compact individual segment flow regulator which does not require the use of special sleeves or differential areas to properly regulate the flow to a changing load.

It is a different object of the present invention to provide an individual segment flow regulator which utilizes a single spring in connection with a single spool to regulate flow to a load.

How these and further objects of the invention are accomplished will be described by reference to the following description of the preferred embodiment of the invention taken in conjunction with the FIGURES. Generally, however, the objects are accomplished in an individual segment flow regulator having a two landed spool and two landed bore, all with the same nominal diameter, a plug, a spring and a sensing passage from the main spool of the valve. Supply oil entering between the two lands of the bore is separated from a sensing pressure by one spool land which is slidable within the bore. The other spool land is normally unsupported and meters the supply fluid. The metering land of the regulator spool opens away from the valve bore land to allow supply fluid through and can shut off the supply. A spring chamber above the spool senses the load pressure when the main spool of the device is opened. Pressure in the spring chamber opens the metering spool, thereby increasing the flow and the pressure drop across the main spool area opening. Feedback pressure is developed at the bottom of the metering land of the spool, against the bias spring pre-load force in the spring chamber and the load pressure. This feedback force is used to close down the regulator spool as the flow, and therefore the pressure drop, across the main spool increases beyond the pre-load force of the bias spring. Therefore, the feedback land at the bottom of the spool is also the metering land that controls supply pressure to the regulated pressure.

The regulator can also act as a maximum segment pressure limiter by inclusion of an orifice in the communicating line between the main spool load sensing flow passage and the load sensing spring chamber of the regulator valve. Once the pressure drop caused by a pilot relief valve exceeds the spring pre-load force on the regulator spool the regulator spool will close off flow to the main spool and will create a slight amount of leakage to maintain the pilot relief set pressure.

Other variations and modifications of the invention will become apparent to those skilled in the art after reading the specification and are deemed to fall within the scope of the present invention if they fall within the scope of the claims which follow the description of the preferred embodiment.

DESCRIPTION OF THE PREFERRED EMBODIMENT

Figure 1:
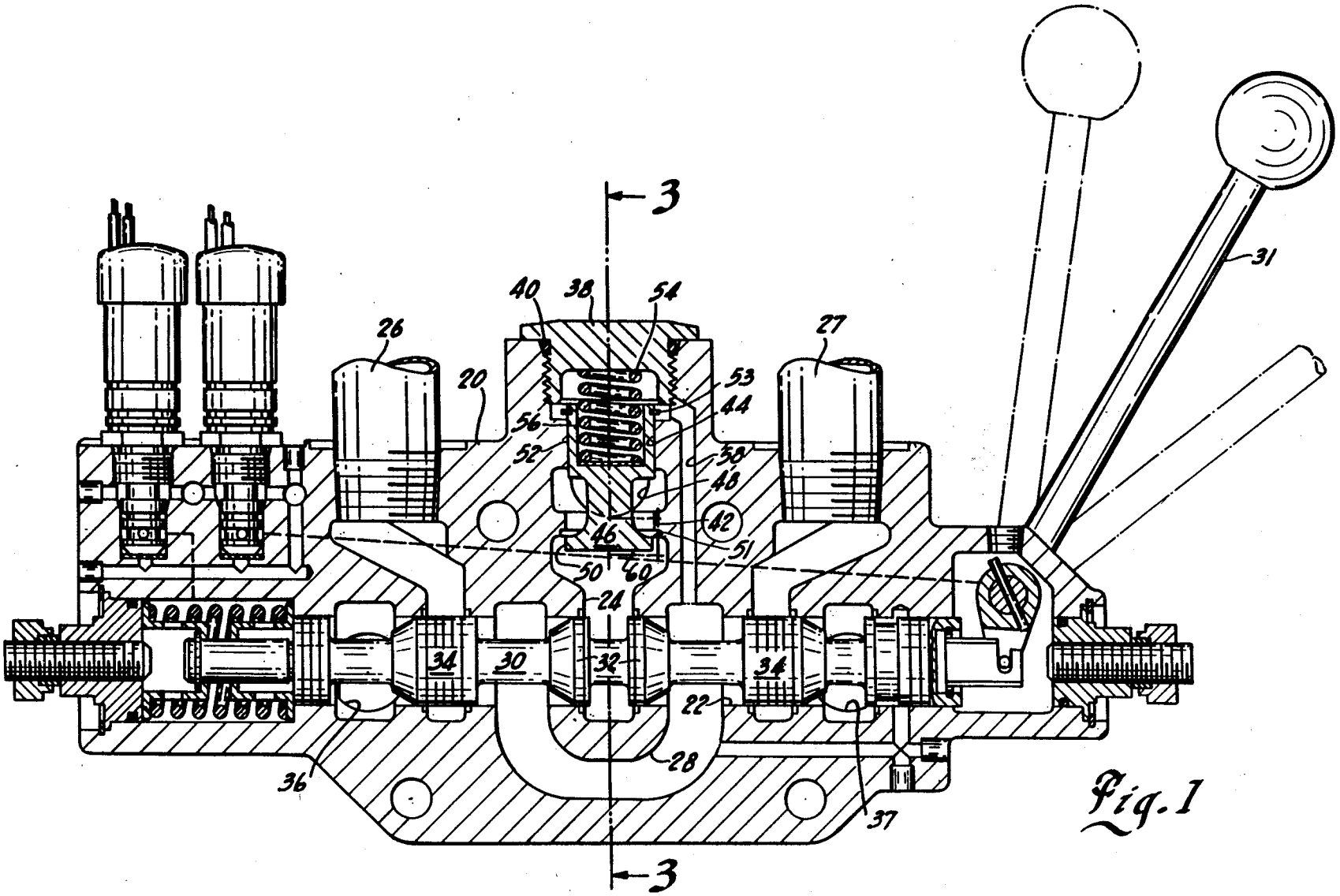
FIG. 1 is a front cross-sectional view of the regulator valve of the present invention in its neutral state.

The regulator of the present invention is shown in FIG. 1 embodied in a housing 20. Two bores are drilled through housing 20, the first being the main spool bore 22 and the two landed regulator compartment 24. Cylinder ports 26, 27 are in communication with the main spool bore 22. Main spool bore 22 intersects regulator compartment 24 perpendicularly, with regulator compartment 24 terminating at it lower end at the main spool bore 22.

A generally U-shaped chamber 28 connects sides of the main spool 30 on either side of the regulator compartment 24. The main spool 30 has a pair of metering lands 32 which permit or restrict fluid communication between chamber 28 and compartment 24. Additionally, main spool 30 has flow direction lands 34 which permit or restrict fluid communication between the chamber 28 and the cylinder ports 26, 27. Movement of the main spool 30 either to the left or the right will permit selective communication between one of the cylinder ports 26, 27 and the regulator compartment 24. When main spool 30 is shifted, the cylinder port which does not receive fluid from the supply communicates with the appropriate exhaust port 36 or 37.

Figure 3:
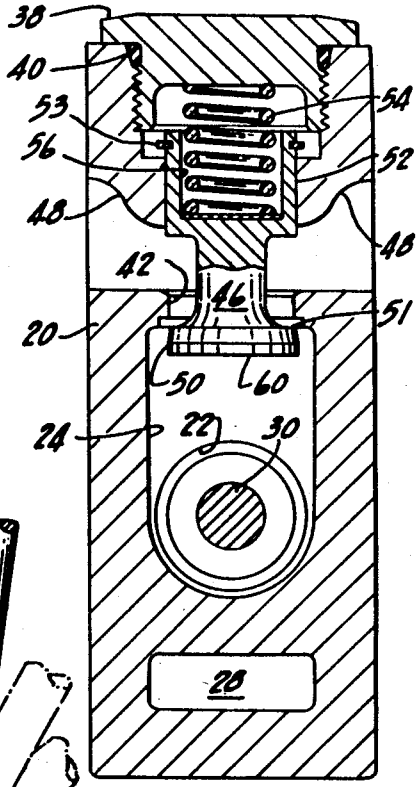
FIG. 3 is a side cross-sectional view of the valve taken along line 3—3 of FIG. 1.

Regulator compartment 24 is sealed at its upper end with a plug 38 utilizing an O-ring 40 to assure a tight seal. Compartment 24 has a first metering land 42 and an upper slidable spool land 44 which acts as a bearing support for the spool 46. Fluid from a supply port 48 enters the regulator compartment 24 between lands 42 and 44. As seen in FIG. 3, regulator spool 46 also has two lands—a metering land 50 and an upper land 52 which slides within the upper bore land 44. In the preferred embodiment, regulator spool lands 50 and 52 and bore lands 42 and 44 all have the same nominal diameters. A bias spring 54 biases the regulator spool 46 downward toward the main spool bore 22. This downward displacement is limited by a limiting ring 53 on spool 46. A spring chamber 56 is defined by the upper portion of regulator spool 46, the plug 38 and the walls of regulator compartment 24. The U-shaped chamber 28 is in fluid communication with the spring chamber 56 by way of a sensing passage 58 therebetween.

The lower surface 60 of regulator spool 46 serves as a feedback surface. That is, fluid under pressure within the regulator compartment 24 beneath land 42 induces a feedback signal on the lower surface 60 of regulator spool 46 which counteracts the force caused by bias spring 54.

Operation

FIG. 1 shows the valve of the present invention in its neutral state, that is, with regulated fluid flow to neither cylinder port 26 nor 27. As can be seen in FIGURE 1, handle 31, which controls the position of main spool 30, may be arcuately moved either up or down. Movement of handle 31 induces movement of the main spool 30.

Figure 2:
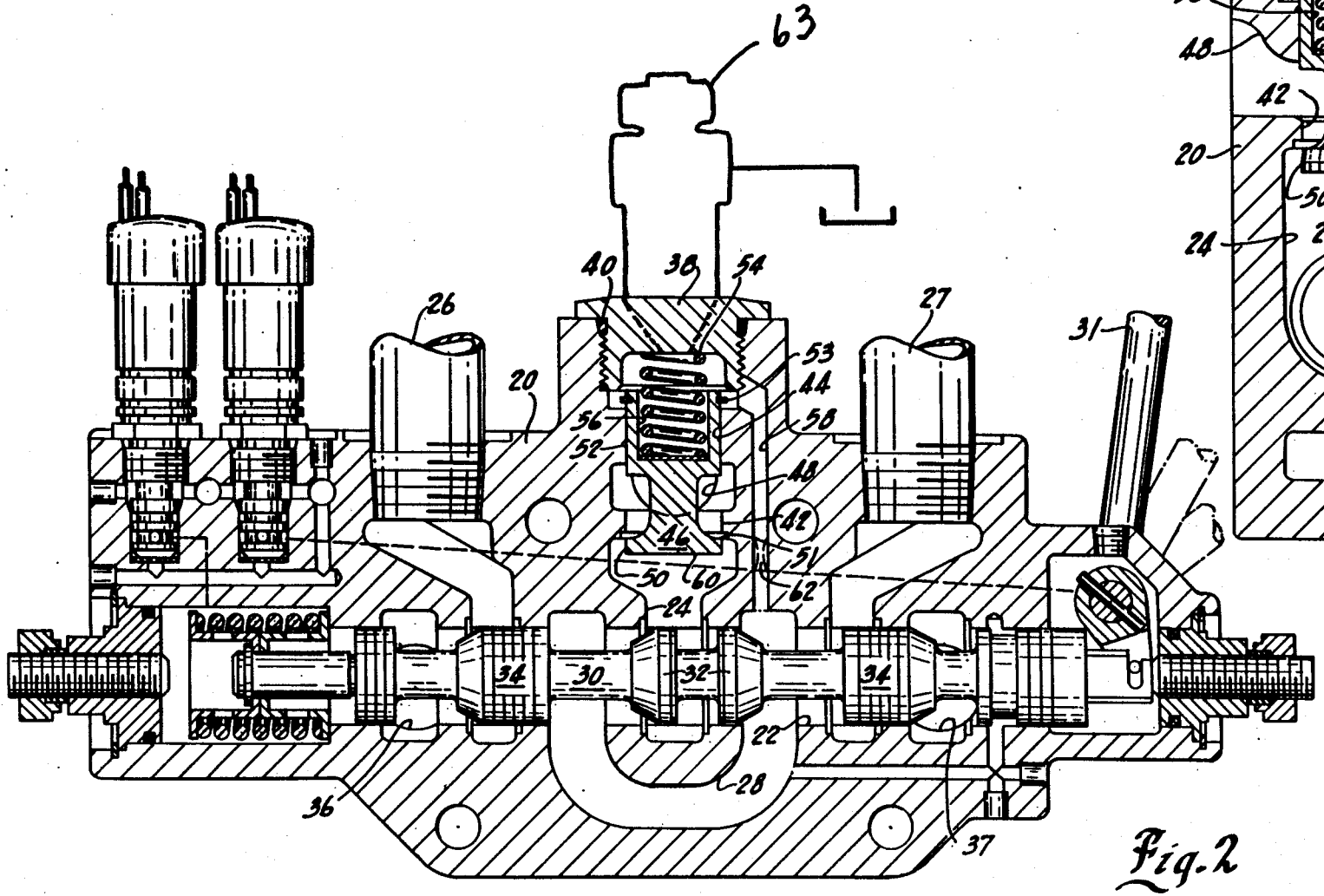
FIG. 2 is a front cross-sectional view of the regulator valve supplying regulated fluid flow to a work port.

FIG. 2 shows the main spool shifted to the right as a result of handle 31 being raised. This right hand movement of the main spool 30 causes fluid communication to open between cylinder port 26 and vent 36, thereby permitting passage of fluid from cylinder port 26 to the exhaust port 36. In a similar fashion, fluid communication is permitted between cylinder port 27 and the supply bore 48.

Supply flow from port 48 is throttled across the unsupported land 50 of the regulator spool 46 as it opens away from the valve bore land 42. The only time the metering land 50 of the regulator spool 46 is supported is when it is shut off.

A load pressure from port 27 is transmitted to the spring chamber 56 above regulator spool 46 when the main directional control spool 30 is shifted to the right, as shown in FIG. 2. As the main spool 30 opens its metering area flow direction along land 34, the load pressure will be sensed in the spring chamber 56. The load pressure acting on the top of the regulator spool 46, will cause the regulator spool metering land 50 to open away from bore land 42. As the regulator spool land 50 opens, the increasing flow to the main spool 30 will result in an increasing pressure drop across the main spool area opening at metering land 32. When the pressure drop across the main spool 30 is equal to the spring force from spring 54 acting on the end of the regulator spool at surface 60, then the spool 46 will modulate around its steady state position. This state of equilibrium is created, in part, by the load pressure acting in the spring chamber on the upper face of regulator spool 46 in addition to the bias spring 54 pre-load force. These combined forces cause the regulator spool metering land 50 to open. Both of these forces are equally opposed by regulated pressure acting on lower face 60 of spool 46.

This opposing force is a feedback force that is used to close down the regulator spool metering land 50 as flow and the pressure drop across the main spool 30 increase beyond the pre-load force of the bias spring 54. The regulated/feedback pressure is upstream of the main spool area opening at land 32, making it a higher pressure than the load pressure due to the pressure drop across the main spool 30. Therefore, the pressure drop across the main spool 30 will equal the spring pre-load force acting on the regulator spool 46 since the load pressure plus the spring pre-load force will collectively equal the regulated pressure. The regulator spool metering land 50 will position itself to allow for the forces to become balanced, and the metering land 50 will automatically adjust its position within chamber 24 as the main spool metering area along metering land 32 changes and/or as the load pressure or supply fluid pressure to the regulator spool 46 itself changes.

The feedback surface 60 at the end of the spool 46 is part of the metering land 50 that throttles the supply pressure from port 48 to the regulated pressure. As the supply fluid pressure is throttled down to a lower "regulated" pressure, the fluid flows around the metering land 50 of the spool 46 to act directly on the area 60 at the end of the spool 46. The regulated pressure creates a feedback force directly upon end 60 of the, spool 46 as the fluid flows to the main spool area opening at metering land 32. An angle 51 is added to the regulator spool metering land 50 to compensate for the flow forces acting on the spool 46. With angle 51 on the spool 46, the spool displacement greatly increases as the flow forces tend to close down the spool opening between metering land 50 nd valve bore land 42. The spool displacement causes the effect of the spring pre-load to increase, which offsets the opposing flow forces.

Another feature which may be added to the system is the ability of the regulator to act as a maximum segment pressure limiter. If an orifice 62, as seen in shadow in FIG. 2, is installed in the communicating line 58 between the main spool load sensing flow passage 28 and the load sensing spring chamber 56 of the regulator valve, then a pressure drop will be taken across the orifice 62 when a pilot relief valve 63 is connected into the spring chamber 56 and as the relief valve is cracked open to its preset valve. Once the pressure drop exceeds the spring pre-load force of spring 54 on the regulator spool 46, the regulator spool 46 will close off flow to the main spool 30 and will create just enough leakage between land 50 and land 42 to maintain a pressure at which the pilot relief was set. This is done to limit the maximum pressure to a function or to maintain a fixed clamping force on a cylinder or a fixed torque on a rotary motor.

Variations, modifications and other applications will become apparent to those skilled in the art. Therefore, the above description of the preferred embodiment is to be interpreted as illustrative rather than limiting. The scope of the present invention is limited only by the scope of the claims that follow.

What is claimed is:

1. A flow regulating valve comprising a valve body having a supply port;

a work port designed to be coupled to a hydraulic device which creates a load pressure at said work port;

an exhaust port capable of exhausting fluid from said work port;

a horizontal bore intersecting said work and port and said exhaust port;

a vertical compartment intersecting said horizontal bore and said supply port, said vertical compartment having no more than two lands, including an upper bore land and a lower bore land, said supply port being located between said upper and lower lands in said vertical compartment;

a main spool in said horizontal bore being movable to allow a first orifice to be opened to a preselectable area between said work port and said vertical compartment, and movable to a position in which said work port communicates with said exhaust port;

a two-landed regulator spool biased downwardly by a biasing force in said vertical compartment, said regulator spool having no more than two lands, including an upper land and a lower land;

wherein said upper land of said vertical compartment and said upper land of said regulator spool form a fluid seal and bearing support that defines an upper chamber in said vertical compartment and a lower chamber in said vertical compartment, and said lower land of said regulator spool and said lower land of said vertical compartment form a second orifice of variable size, the size of said second orifice being determined by the position of said regulator spool in said vertical compartment;

a sensing passage connecting said upper chamber to said work port to allow the load pressure to be sensed in said upper chamber;

wherein when said main spool is positioned to open the first orifice to a preselected area, the load pressure is sensed in said upper chamber and pushes downwardly on the upper face of said regulator spool, a feedback pressure in said lower chamber pushing upwardly on the lower face of said regulator spool, the position of said regulator spool thereby being determined by the difference in the feedback pressure exerted on the bottom of said regulator spool and the combined pressure of said biasing force and the load pressure exerted on the top of said regulator spool.

2. The valve as recited in claim 1 wherein said upper land and said lower land of said vertical compartment and said upper land and said lower land of said regulator spool all have the same nominal diameter.

3. The valve as recited in claim 2 wherein said vertical compartment is sealed end with a plug and said biasing force is caused by a spring located between said plug and the upper face of said regulator spool.

4. The valve as recited in claim 3 wherein said lower land of said regulator spool is tapered to compensate for flow forces acting on said regulator spool.

5. The valve as recited in claim 4 wherein an intermediate, U-shaped chamber is positioned with its upper ends intersecting said horizontal bore on either side of the intersection of said horizontal bore with said vertical compartment, said intermediate chamber contacting said work port, said sensing passage and said first orifice.

6. The valve as recited in claim 5 wherein a fixed third orifice is placed in said sensing passage and a pilot relief valve is coupled to said upper chamber, thereby limiting the maximum pressure within said intermediate chamber in said horizontal bore.

7. The valve as recited in claim 6 wherein said regulator spool further includes a limiting ring to limit the downward movement of said regulator spool in said vertical compartment.

8. A flow regulating valve designed to control flow of a fluid to a load, said valve comprising:

a valve body;

a first, generally cylindrical bore extending horizontally through said body;

a second, generally cylindrical two-landed compartment extending vertically in said body, said second compartment intersecting said first bore perpendicularly, said second compartment having no more than two lands, including an upper bore land and a lower bore land, the portion of said second compartment above said upper land being sealed and forming a spring chamber, the portion of said second compartment below said lower land being a feedback chamber, the portion of said second compartment between said first and second lands being a supply chamber;

a first work port and a first exhaust port in communication with said first bore;

a two-landed regulator spool in said second compartment, said regulator spool having no more than two lands, including an upper land and a lower land, said lower land of said regulator spool being movable between a first open position and a second closed position, said regulator spool being biased toward said first open position by a spring in said spring chamber;

a main spool in said first bore selectively permitting sealing off of said first work port from said first bore, fluid communication between said feedback chamber and said first work port, and fluid communication between said first work port and said first exhaust port;

a sensing passage connecting said spring chamber and said first bore;

a supply port designed to deliver fluid to said supply chamber;

wherein when said regulator spool is in said first open position, said lower spool land and said lower bore land are spaced apart thereby permitting fluid from said supply port to flow to said feedback chamber, and when said regulator spool is in said second closed position, said lower spool land and said lower bore land seal off fluid flow between said supply port and said feedback camber;

and further wherein the position of said regulator spool within said second compartment is determined by the difference between the pressure in said feedback chamber acting on the bottom of said regulator spool and the combined pressure of said spring and the fluid pressure in said spring chamber acting on the top of said regulator spool.

9. The valve as recited in claim 8 wherein said upper land and said lower land of said second compartment and said upper land and said lower land of said regulator spool all have the same nominal diameter.

10. The valve as recited in claim 9 wherein said lower land of said regulator spool is tapered to compensate for flow forces acting on said regulator spool.

11. The valve as recited in claim 10 wherein a fixed orifice is placed in said sensing passage and a pilot relief value is coupled to said spring chamber, thereby limiting the maximum pressure within said first bore.

12. The valve as recited in claim 11 wherein said regulator spool further indicates a limiting ring to limit the downward movement of said regulator spool in said second compartment.

13. A flow regulating valve designed to regulate flow of a fluid to a hydraulic device supporting a load, said valve having a valve body with an exhaust port and means for supplying fluid to said body and comprising:

(a) a work port designed to be coupled to a hydraulic device supporting a load;

(a) a compartment having a chamber perpendicularly intersecting a bore, said compartment also intersecting said supply means, said compartment having no more than two lands; and main spool in said bore having metering land means to allow an orifice to be opened to a preselectable area between said bore and said compartment, and having flow direction land means downstream of said metering land means to control communication between said bore and said work port and between said work port and said exhaust;

(c) means for sensing the load pressure induced by a load coupled to said work port;

(b) means in said chamber for generating a feedback pressure representative of the flow of fluid from said supply means to said work port;

(e) means in said compartment for comparing the load pressure and the feedback pressure, said comparing means comprising a generally cylindrical regulator spool upstream of said metering land means having no more than two lands, having an upper face and a lower face, axially movable within said compartment and positioned so that the feedback pressure is sensed on said lower face of said regulator spool in said compartment, the position of said regulator spool thereby being determined by the difference between the load pressure and the feedback pressure.

14. A flow regulating valve comprising a valve body having a supply port;

a work port designed to be coupled to a hydraulic device which creates a load pressure at said work port;

an exhaust port capable of exhausting fluid from said work port;

a horizontal bore intersecting said work port and said exhaust port;

a vertical compartment intersecting said horizontal bore and said supply port, said vertical compartment having no more than two lands, including an upper land and a lower land, said supply port being located between said upper and lower lands in said vertical compartment, sand said vertical compartment being sealed with a plug at its upper end;

a main spool in said horizontal bore being movable to allow a first orifice to be opened to a preselectable area between said work port and said vertical compartment, and movable to a position in which said work port communicates with said exhaust port;

a two-landed regulator spool biased downwardly by a spring in said vertical compartment, said regulator spool having no more than two lands, including an upper land and a lower land and a limiting ring to limit the downward movement of said regulator spool in said vertical compartment, said regulator spool being tapered to compensate for flow forces acting on said regulator spool;

wherein said upper land and said lower land of said vertical compartment and said upper land and said lower land of said regulator spool all have the same nominal diameter, and said upper land of said vertical compartment and said upper land of said regulator spool form a fluid seal and bearing support that defines an upper chamber in said vertical compartment and a lower chamber in said vertical compartment, and said lower land of said regulator spool and said lower land of said vertical compartment form a second orifice of variable size, the size of said second orifice being determined by the position of said regulator spool in said vertical compartment;

a sensing passage connecting said upper chamber to said work port to allow the load pressure to be sensed in said upper chamber;

wherein when said main spool is positioned to open the first orifice to a preselected area, the load pressure is sensed in said upper chamber and pushes downwardly on the upper face of said regulator spool, a feedback pressure in said lower chamber pushing upwardly on the lower face of said regulator spool, the position of said regulator spool thereby being determined by the difference in the feedback pressure exerted on the bottom of said regulator spool and the combined pressure of said spring and the load pressure exerted on the top of said regulator spool.

15. The valve as recited in claim 14 wherein an intermediate, U-shaped chamber is positioned with its upper ends intersecting said horizontal bore on either side of the intersection of said horizontal bore with said vertical compartment, said intermediate chamber connecting said work port, said sensing passage and said first orifice.

16. The valve as recited in claim 15 wherein a fixed third orifice is placed in said sensing passage and a pilot relief valve is coupled to said upper chamber, thereby limiting the maximum pressure within said intermediate chamber in said horizontal bore.

17. A flow regulating valve comprising a valve body having a supply port;

a first work port designed to be coupled to a hydraulic device which creates a load pressure at said first work port;

a second work port designed to be coupled to a hydraulic device which creates a load pressure at said second work port;

a first exhaust port capable of exhausting fluid form said first work port;

a second exhaust port capable of exhausting fluid from said second work port;

a horizontal bore intersecting said first and second work ports and said first and second exhaust ports;

a vertical compartment intersecting said horizontal bore in said supply port, said vertical compartment having no more than two lands, including an upper bore land and a lower bore land, said supply port being located between said upper and lower lands in said vertical compartment;

a man spool in said horizontal bore being movable to allow a first orifice to be opened to a preselectable area between said first work port and said vertical compartment while simultaneously opening fluid communication between said second work port and said second exhaust port, and movable to allow a second orifice to be opened to a preselected area between said second work port and said vertical compartment while simultaneously opening fluid communication between said first work port and said first exhaust port;

a two-landed regulator spool biased downwardly by a biasing force in said vertical compartment, said regulator spool having no more than two lands, including an upper land and a lower land;

wherein said upper land of said vertical compartment and said upper land of said regulator spool form a fluid seal and bearing support that defines an upper chamber in said vertical compartment and a lower chamber in said vertical compartment and said lower land of said regulator spool and said lower land of said vertical compartment form a third orifice of variable size, the size of said third orifice being determined by the position of said regulator spool in said vertical compartment;

a sensing passage connecting said upper chamber to which ever of said work ports is in communication with said vertical compartment to allow the load pressure to be sensed in said upper chamber;

wherein when said main spool is positioned to open said first orifice or said second orifice to a preselectable area, the load pressure is sensed in said upper chamber and pushes downwardly on the upper face of said regulator spool, a feedback pressure in said lower chamber pushing upwardly on the lower face of said regulator spool, the position of said regulator spool thereby being determined by the difference in the feedback pressure exerted on the bottom of said regulator spool and the combined pressure of said biasing force and the load pressure exerted on the top of said regulator spool.

18. The valve as recited in claim 17 wherein said upper land and said lower land of said vertical compartment and said upper land and said lower land of said regulator spool all have the same nominal diameter.

19. The valve as recited in claim 18 wherein said vertical compartment is sealed at its upper end with a plug and said biasing force is caused by a spring located between said plug and the upper face of said regulator spool.

20. The valve as recited in claim 19 wherein said regulator spool further includes a limiting ring to limit the downward movement of said regulator spool in said vertical compartment.

21. The valve as recited in claim 20 wherein said lower land of said regulator spool is tapered to compensate for flow forces acting on said regulator spool.

22. The valve as recited in claim 21 wherein an intermediate, U-shaped chamber is positioned with its upper ends intersecting said horizontal bore on either side of the intersection of said horizontal bore with said vertical compartment, said intermediate chamber connecting said first and second work ports, said sensing passage and said first and second orifices.

23. The valve as recited in claim 22 wherein a fixed fourth orifice is placed in said sensing passage and a pilot relief valve is coupled to said upper chamber, thereby limiting the maximum pressure within said intermediate chamber in said horizontal bore.

* * * * *

UNITED STATES PATENT OFFICE

CERTIFICATE OF CORRECTION

Patent No. 4,889,161 Dated December 26, 1989

Inventor(s) James P. Janecke

It is certified that error appears in the above-identified patent and that said Letters Patent is hereby corrected as shown below:

Column 5, line 53, after "sealed", add ---at its upper---.

Column 5, line 63, "contacting" should be ---connecting---.

Column 6, line 51, "camber" should be ---chamber---.

Column 7, line 4, "indicates" should be ---includes---.

Column 7, line 13, "(a)" should be ---(b)---.

Column 7, line 23, after "exhaust", add ---port---.

Column 7, line 27, "(b)" should be ---(d)---.

Column 7, line 36, after "lower" add ---face of said regulator spool in said chamber and the load pressure is sensed on said upper---.

Column 7, line 55, "sand" should be ---and---.

UNITED STATES PATENT AND TRADEMARK OFFICE

CERTIFICATE OF CORRECTION

PATENT NO. : 4,889,161

DATED : December 26, 1989

INVENTOR(S) : James P. Janecke

It is certified that error appears in the above-identified patent and that said Letters Patent is hereby corrected as shown below:

Column 8, line 52, "form" should be --from--.

Column 8, line 64, "man" should be --main--.

Signed and Sealed this

Ninth Day of April, 1991

*Attest:*

HARRY F. MANBECK, JR.

*Attesting Officer*

*Commissioner of Patents and Trademarks*